US011837828B2

(12) United States Patent
Mutnury et al.

(10) Patent No.: US 11,837,828 B2
(45) Date of Patent: Dec. 5, 2023

(54) MEMORY MODULE SOCKET FOR AN INFORMATION HANDLING SYSTEM

(71) Applicant: Dell Products L.P., Round Rock, TX (US)

(72) Inventors: Bhyrav M. Mutnury, Austin, TX (US); Mark A. Smith, Georgetown, TX (US); Sandor Farkas, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 208 days.

(21) Appl. No.: 17/451,696

(22) Filed: Oct. 21, 2021

(65) Prior Publication Data

US 2023/0130196 A1 Apr. 27, 2023

(51) Int. Cl.

| | |
|---|---|
| ***H01R 33/76*** | (2006.01) |
| ***H01R 33/96*** | (2006.01) |
| ***H01R 12/72*** | (2011.01) |

(52) U.S. Cl.
CPC ..... *H01R 33/765* (2013.01); *H01R 12/721* (2013.01); *H01R 33/96* (2013.01)

(58) Field of Classification Search
CPC ..... H01R 13/7031; H01R 12/716; H01R 12/721; H01R 33/765; H01R 33/96
USPC ..... 439/188
See application file for complete search history.

(56) References Cited

U.S. PATENT DOCUMENTS

| | | | | |
|---|---|---|---|---|
| 3,903,385 | A * | 9/1975 | Moyer | H01R 12/721 200/243 |
| 5,024,609 | A * | 6/1991 | Piorunneck | H01R 12/721 439/924.1 |
| 5,098,306 | A * | 3/1992 | Noschese | H01R 12/721 439/637 |
| 5,197,887 | A * | 3/1993 | Davidge | H01R 12/88 439/60 |
| 6,508,665 | B1 * | 1/2003 | Yeh | H01R 13/6658 439/541.5 |
| 6,592,407 | B2 * | 7/2003 | Korunsky | H01R 12/721 439/108 |
| 8,936,488 | B2 * | 1/2015 | Bahali | H01R 13/6616 439/637 |
| 9,941,643 | B2 * | 4/2018 | Chu | H01R 13/7034 |
| 10,050,386 | B1 * | 8/2018 | Pickel | H01R 13/6473 |
| 10,490,920 | B2 * | 11/2019 | Manickam | H01R 13/648 |
| 2014/0153194 | A1 * | 6/2014 | Bahali | H01R 13/7197 361/728 |
| 2019/0214755 | A1 * | 7/2019 | Manickam | H01R 12/721 |

(Continued)

*Primary Examiner* — Peter G Leigh
(74) *Attorney, Agent, or Firm* — McDermott Will & Emery LLP

(57) ABSTRACT

A memory module socket, including a first member extending between a first end and a second end of the socket, the second end of the socket opposite to the first end of the socket, the first member positioned along a first side of the socket, the first member including: a plurality of first contact pins, each of the first contact pins including a first contact point and a second contact point; a plurality of first resistive coatings connecting two or more of the first contact pins to define first groupings of contact pins; a plurality of first ribs separating each of the first groupings of first contact pins; wherein when the first contact pins are in a first position, the second contact points of the first contact pins are in contact with respective first resistive coatings to complete a termination to ground.

18 Claims, 6 Drawing Sheets

(56) References Cited

U.S. PATENT DOCUMENTS

| | | | | |
|---|---|---|---|---|
| 2020/0076131 | A1* | 3/2020 | Hu | H01R 12/737 |
| 2020/0076135 | A1* | 3/2020 | Tang | H01R 12/724 |
| 2021/0307156 | A1* | 9/2021 | Miller | H01R 12/73 |

* cited by examiner

MEMORY MODULE SOCKET FOR AN INFORMATION HANDLING SYSTEM

BACKGROUND

Field of the Disclosure

The disclosure relates generally to an information handling system, and in particular, a memory module socket for an information handling system.

Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

With DDR speeds approaching PCIe speeds, reflections become more important than ever. With the advent of equalization approaches like DFE (decision feedback equalization) both at memory controller and memory modules, the impact of loss is mitigated, but reflections are only mitigated to some extent.

SUMMARY

Innovative aspects of the subject matter described in this specification may be embodied in a memory module socket, including a first member extending between a first end and a second end of the socket, the second end of the socket opposite to the first end of the socket, the first member positioned along a first side of the socket, the first member including: a plurality of first contact pins, each of the first contact pins including a first contact point and a second contact point; a plurality of first resistive coatings connecting two or more of the first contact pins to define first groupings of contact pins; a plurality of first ribs separating each of the first groupings of first contact pins; wherein when the first contact pins are in a first position, the second contact points of the first contact pins are in contact with respective first resistive coatings to complete a termination to ground.

Other embodiments of these aspects include corresponding systems and apparatus.

These and other embodiments may each optionally include one or more of the following features. For instance, a second member extending between the first end and the second end of the socket, the second member positioned along a second side of the socket, the second side of the socket opposite to the first side of the socket, the second member including: a plurality of second contact pins, each of the second contact pins including a first contact point and a second contact point; a plurality of second resistive coatings connecting two or more of the second contact pins to define second groupings of contact pins; and a plurality of second ribs separating each of the second groupings of second contact pins. When the second contact pins are in the first position, the second contact points of the second contact pins are in contact with respective second resistive coatings to complete a termination to ground. When the first and the second contact pins are in the first position, a memory module is decoupled from the socket. When the first and the second contact pins are in a second position, the first contact points of the first and the second contact pins contact the memory module, and the second contact points of the first and the second contact pins are disconnected from termination. When the first and the second contact pins are in the second position, the memory module is coupled to the socket. A first contact pin of the first grouping of contact pins is a ground pin. A second contact pin of the first grouping of contact pins is a data pin. A third contact pin of the first grouping of contact is a data pin.

Particular implementations of the subject matter described in this specification can be implemented so as to realize one or more of the following advantages. For example, reflections from an open connector of a memory module socket are reduced while increasing margins.

The details of one or more embodiments of the subject matter described in this specification are set forth in the accompanying drawings and the description below. Other potential features, aspects, and advantages of the subject matter will become apparent from the description, the drawings, and the claims.

DESCRIPTION OF PARTICULAR EMBODIMENT(S)

Figure 1:
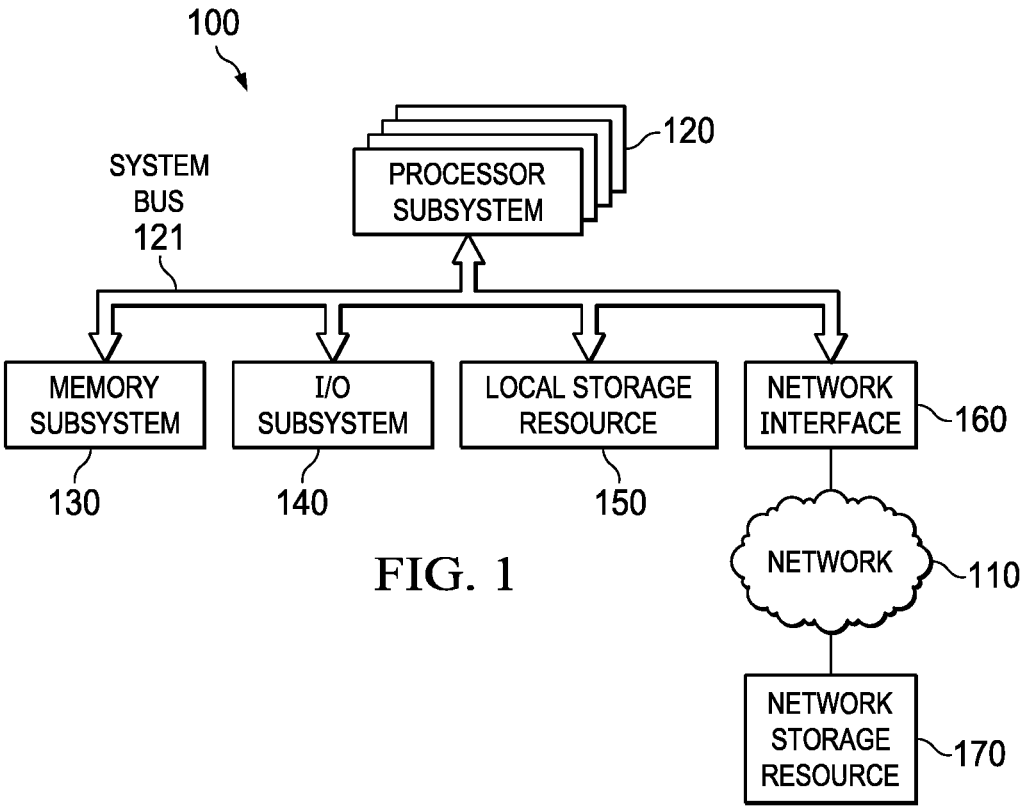
FIG. 1 is a block diagram of selected elements of an embodiment of an information handling system.

This disclosure discusses a memory module socket of an information handling system. In short, the memory module socket can be a self-terminating memory module socket that connects each signal pin through a resistive termination to ground when a memory module is not coupled with the memory module socket.

Specifically, this disclosure discusses a memory module socket, including a first member extending between a first end and a second end of the socket, the second end of the socket opposite to the first end of the socket, the first member positioned along a first side of the socket, the first member including: a plurality of first contact pins, each of the first contact pins including a first contact point and a second contact point; a plurality of first resistive coatings connecting two or more of the first contact pins to define first groupings of contact pins; a plurality of first ribs separating each of the first groupings of first contact pins; wherein when the first contact pins are in a first position, the second contact points of the first contact pins are in contact with respective first resistive coatings to complete a termination to ground.

In the following description, details are set forth by way of example to facilitate discussion of the disclosed subject matter. It should be apparent to a person of ordinary skill in the field, however, that the disclosed embodiments are exemplary and not exhaustive of all possible embodiments.

For the purposes of this disclosure, an information handling system may include an instrumentality or aggregate of instrumentalities operable to compute, classify, process, transmit, receive, retrieve, originate, switch, store, display, manifest, detect, record, reproduce, handle, or utilize various forms of information, intelligence, or data for business, scientific, control, entertainment, or other purposes. For example, an information handling system may be a personal computer, a PDA, a consumer electronic device, a network storage device, or another suitable device and may vary in size, shape, performance, functionality, and price. The information handling system may include memory, one or more processing resources such as a central processing unit (CPU) or hardware or software control logic. Additional components of the information handling system may include one or more storage devices, one or more communications ports for communicating with external devices as well as various input and output (I/O) devices, such as a keyboard, a mouse, and a video display. The information handling system may also include one or more buses operable to transmit communication between the various hardware components.

For the purposes of this disclosure, computer-readable media may include an instrumentality or aggregation of instrumentalities that may retain data and/or instructions for a period of time. Computer-readable media may include, without limitation, storage media such as a direct access storage device (e.g., a hard disk drive or floppy disk), a sequential access storage device (e.g., a tape disk drive), compact disk, CD-ROM, DVD, random access memory (RAM), read-only memory (ROM), electrically erasable programmable read-only memory (EEPROM), and/or flash memory (SSD); as well as communications media such wires, optical fibers, microwaves, radio waves, and other electromagnetic and/or optical carriers; and/or any combination of the foregoing.

Particular embodiments are best understood by reference to FIGS. 1-6 wherein like numbers are used to indicate like and corresponding parts.

Turning now to the drawings, FIG. 1 illustrates a block diagram depicting selected elements of an information handling system 100 in accordance with some embodiments of the present disclosure. In various embodiments, information handling system 100 may represent different types of portable information handling systems, such as, display devices, head mounted displays, head mount display systems, smart phones, tablet computers, notebook computers, media players, digital cameras, 2-in-1 tablet-laptop combination computers, and wireless organizers, or other types of portable information handling systems. In one or more embodiments, information handling system 100 may also represent other types of information handling systems, including desktop computers, server systems, controllers, and microcontroller units, among other types of information handling systems. Components of information handling system 100 may include, but are not limited to, a processor subsystem 120, which may comprise one or more processors, and system bus 121 that communicatively couples various system components to processor subsystem 120 including, for example, a memory subsystem 130, an I/O subsystem 140, a local storage resource 150, and a network interface 160. System bus 121 may represent a variety of suitable types of bus structures, e.g., a memory bus, a peripheral bus, or a local bus using various bus architectures in selected embodiments. For example, such architectures may include, but are not limited to, Micro Channel Architecture (MCA) bus, Industry Standard Architecture (ISA) bus, Enhanced ISA (EISA) bus, Peripheral Component Interconnect (PCI) bus, PCI-Express bus, HyperTransport (HT) bus, and Video Electronics Standards Association (VESA) local bus.

As depicted in FIG. 1, processor subsystem 120 may comprise a system, device, or apparatus operable to interpret and/or execute program instructions and/or process data, and may include a microprocessor, microcontroller, digital signal processor (DSP), application specific integrated circuit (ASIC), or another digital or analog circuitry configured to interpret and/or execute program instructions and/or process data. In some embodiments, processor subsystem 120 may interpret and/or execute program instructions and/or process data stored locally (e.g., in memory subsystem 130 and/or another component of information handling system). In the same or alternative embodiments, processor subsystem 120 may interpret and/or execute program instructions and/or process data stored remotely (e.g., in network storage resource 170).

Also in FIG. 1, memory subsystem 130 may comprise a system, device, or apparatus operable to retain and/or retrieve program instructions and/or data for a period of time (e.g., computer-readable media). Memory subsystem 130 may comprise random access memory (RAM), electrically erasable programmable read-only memory (EEPROM), a PCMCIA card, flash memory, magnetic storage, opto-magnetic storage, and/or a suitable selection and/or array of volatile or non-volatile memory that retains data after power to its associated information handling system, such as system 100, is powered down.

In information handling system 100, I/O subsystem 140 may comprise a system, device, or apparatus generally operable to receive and/or transmit data to/from/within information handling system 100. I/O subsystem 140 may represent, for example, a variety of communication interfaces, graphics interfaces, video interfaces, user input interfaces, and/or peripheral interfaces. In various embodiments, I/O subsystem 140 may be used to support various peripheral devices, such as a touch panel, a display adapter, a keyboard, an accelerometer, a touch pad, a gyroscope, an IR sensor, a microphone, a sensor, or a camera, or another type of peripheral device.

Local storage resource 150 may comprise computer-readable media (e.g., hard disk drive, floppy disk drive, CD-ROM, and/or other type of rotating storage media, flash memory, EEPROM, and/or another type of solid state storage media) and may be generally operable to store instructions and/or data. Likewise, the network storage resource may comprise computer-readable media (e.g., hard disk drive, floppy disk drive, CD-ROM, and/or other type of rotating storage media, flash memory, EEPROM, and/or other type of solid state storage media) and may be generally operable to store instructions and/or data.

In FIG. 1, network interface 160 may be a suitable system, apparatus, or device operable to serve as an interface between information handling system 100 and a network 110. Network interface 160 may enable information handling system 100 to communicate over network 110 using a suitable transmission protocol and/or standard, including, but not limited to, transmission protocols and/or standards enumerated below with respect to the discussion of network 110. In some embodiments, network interface 160 may be communicatively coupled via network 110 to a network storage resource 170. Network 110 may be a public network or a private (e.g. corporate) network. The network may be implemented as, or may be a part of, a storage area network (SAN), personal area network (PAN), local area network (LAN), a metropolitan area network (MAN), a wide area network (WAN), a wireless local area network (WLAN), a virtual private network (VPN), an intranet, the Internet or another appropriate architecture or system that facilitates the communication of signals, data and/or messages (generally referred to as data). Network interface 160 may enable wired and/or wireless communications (e.g., NFC or Bluetooth) to and/or from information handling system 100.

In particular embodiments, network 110 may include one or more routers for routing data between client information handling systems 100 and server information handling systems 100. A device (e.g., a client information handling system 100 or a server information handling system 100) on network 110 may be addressed by a corresponding network address including, for example, an Internet protocol (IP) address, an Internet name, a Windows Internet name service (WINS) name, a domain name or other system name. In particular embodiments, network 110 may include one or more logical groupings of network devices such as, for example, one or more sites (e.g. customer sites) or subnets. As an example, a corporate network may include potentially thousands of offices or branches, each with its own subnet (or multiple subnets) having many devices. One or more client information handling systems 100 may communicate with one or more server information handling systems 100 via any suitable connection including, for example, a modem connection, a LAN connection including the Ethernet or a broadband WAN connection including DSL, Cable, Ti, T3, Fiber Optics, Wi-Fi, or a mobile network connection including GSM, GPRS, 3G, or WiMax.

Network 110 may transmit data using a desired storage and/or communication protocol, including, but not limited to, Fibre Channel, Frame Relay, Asynchronous Transfer Mode (ATM), Internet protocol (IP), other packet-based protocol, small computer system interface (SCSI), Internet SCSI (iSCSI), Serial Attached SCSI (SAS) or another transport that operates with the SCSI protocol, advanced technology attachment (ATA), serial ATA (SATA), advanced technology attachment packet interface (ATAPI), serial storage architecture (SSA), integrated drive electronics (IDE), and/or any combination thereof. Network 110 and its various components may be implemented using hardware, software, or any combination thereof.

Figure 2:
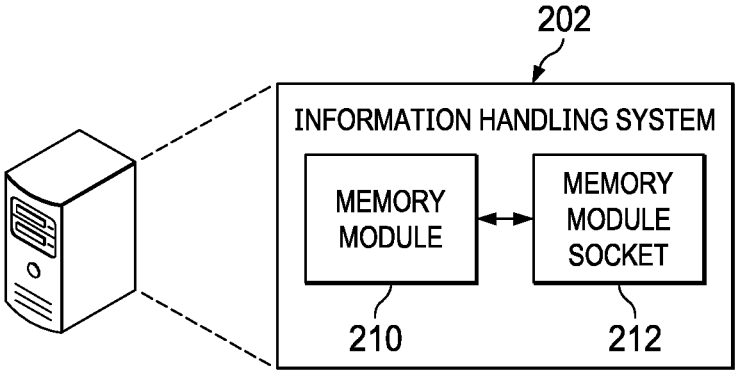
FIG. 2 illustrates a block diagram of an information handling system a memory module socket and a memory module.

Turning to FIG. 2, FIG. 2 illustrates an environment 200 including an information handling system 202. The information handling system 202 can include a memory module 210 and a memory module socket 212. In some examples, the information handling system 202 is similar to, or includes, the information handling system 100 of FIG. 1.

The memory module 210 can be coupled or decoupled from the memory module socket 212, described further herein.

In some examples, the memory module 210 is a dual in-line memory module (DIMM).

Figure 3A:
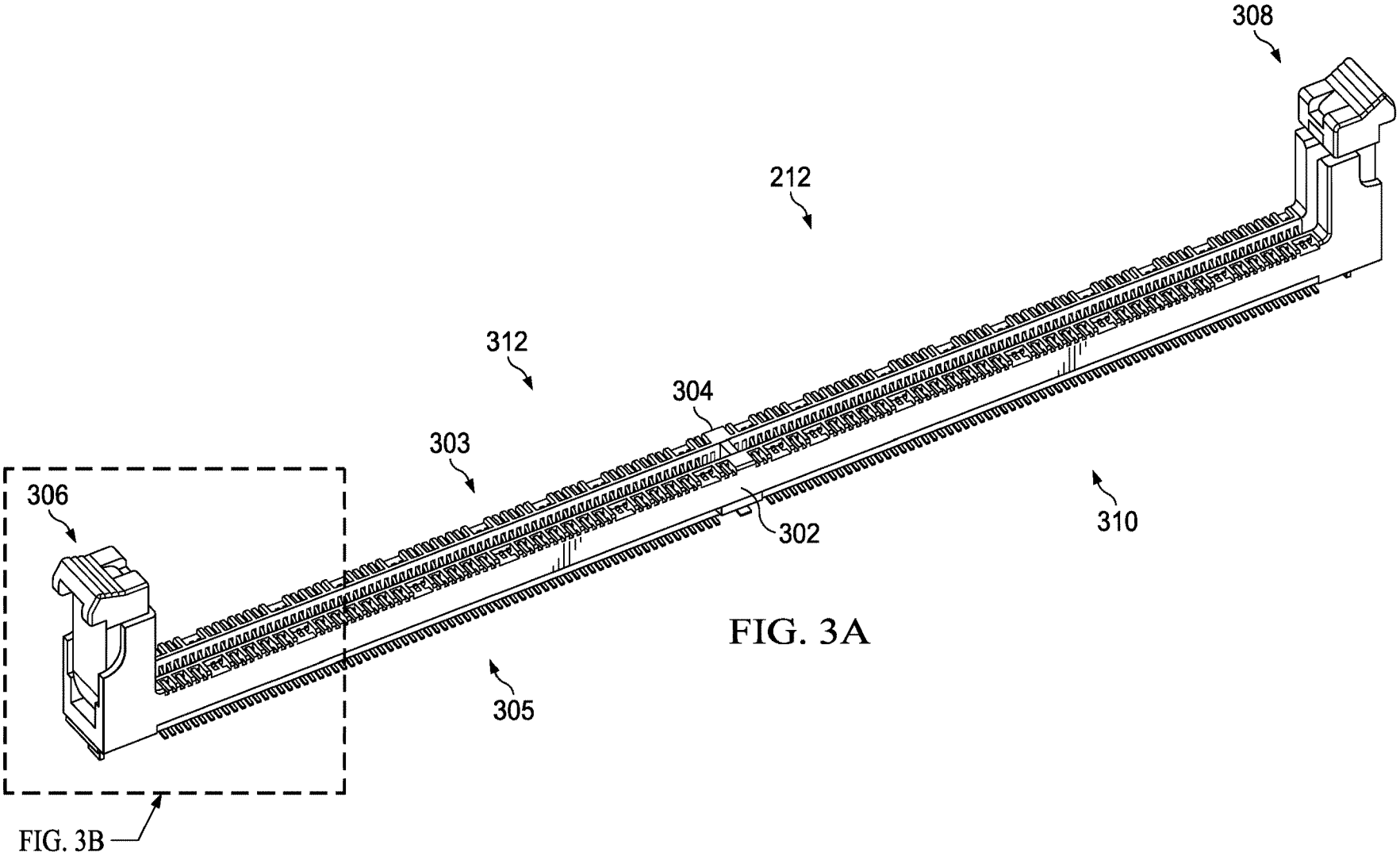
FIGS. 3A-3C are perspective views of the memory module socket.
Figure 3B:
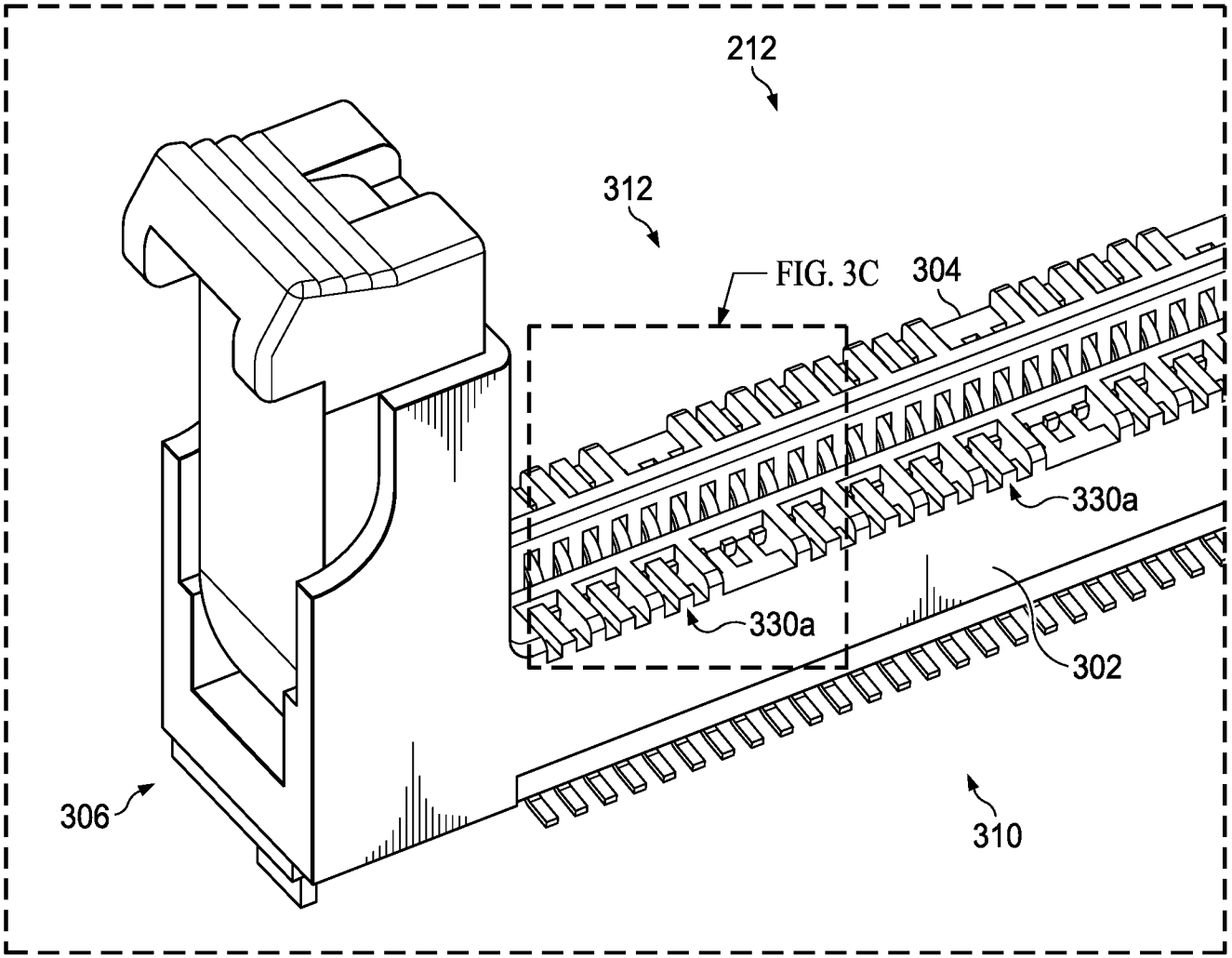
Figure 3C:
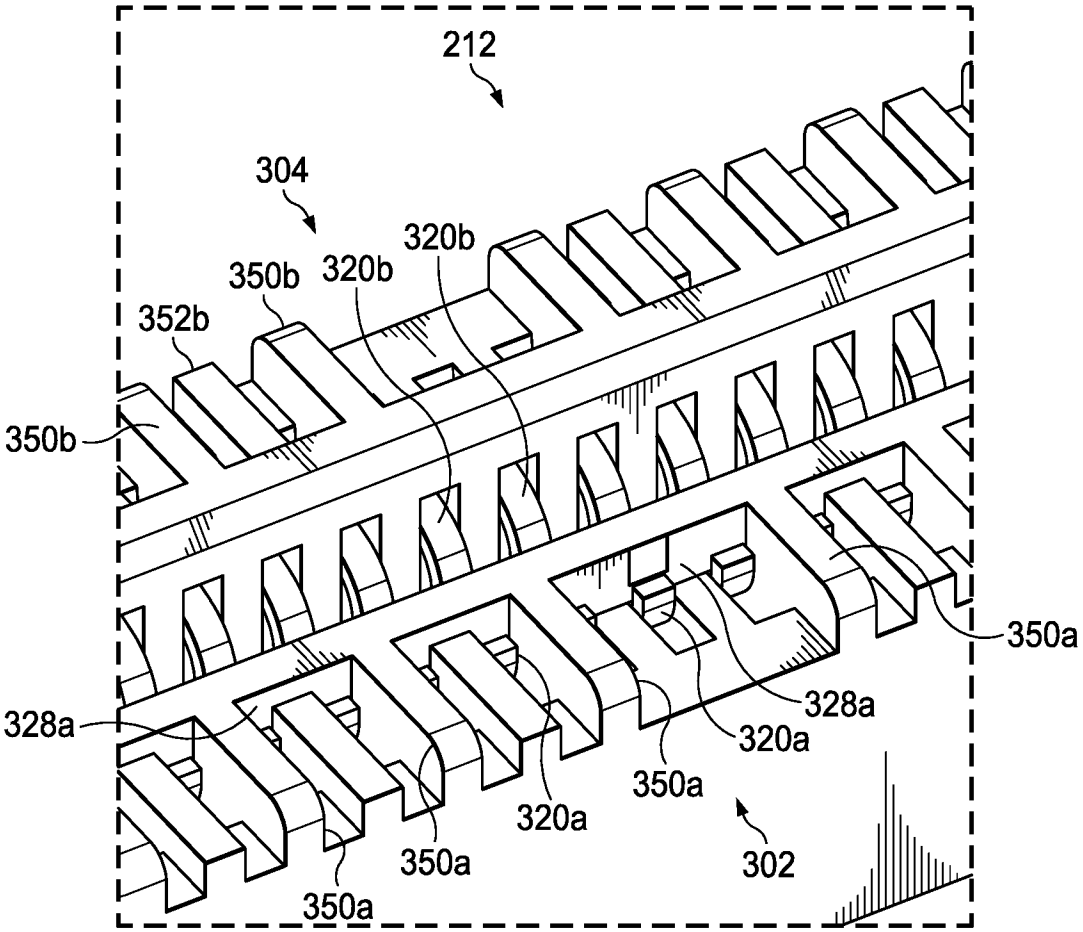

FIGS. 3A, 3B, 3C illustrate perspective views of the memory module socket 212. The memory module socket 212 can include a first member 302 and a second member 304. The first member 302 and the second member 304 can extend between a first end 306 and a second end 308 of the memory module socket 212. The first end 306 of the memory module socket 212 is opposite to the second end 308 of the memory module socket 212. The first member 302 is positioned along a first side 310 of the memory module socket 212. The second member 304 is positioned along a second side 312 of the memory module socket 212. The first side 310 of the memory module socket 212 is opposite to the second side 312 of the memory module socket 212. The memory module socket 212 can include a top side 250 positioned opposite to a bottom side 252.

Figure 4:
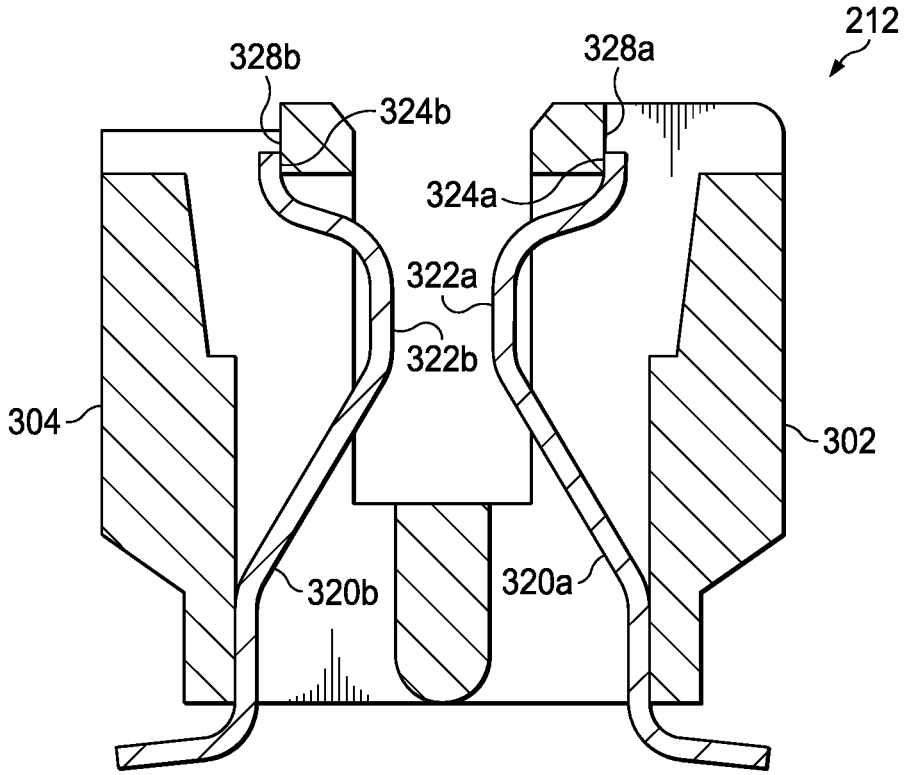
FIG. 4 is a side cutaway view of the memory module socket, with the memory module decoupled from the memory module socket.

Referring to FIGS. 3C and 4, the first member 302 can include a plurality of first contact pins 320*a*. Each of the first contact pins 320*a* can include a first contact point 322*a* and a second contact point 324*a*. The second member 304 can include a plurality of second contact pins 320*b*. The first contact pins 320*a* and the second contact pins 320*b* can collectively be referred to as contact pins 320. Each of the second contact pins 320*b* can include a first contact point 322*b* and a second contact point 324*b*. The first contact points 322*a*, 322*b* can collectively be referred to as first contact points 322. The second contact points 324*a*, 324*b* can collectively be referred to as second contact points 324.

Figure 5:
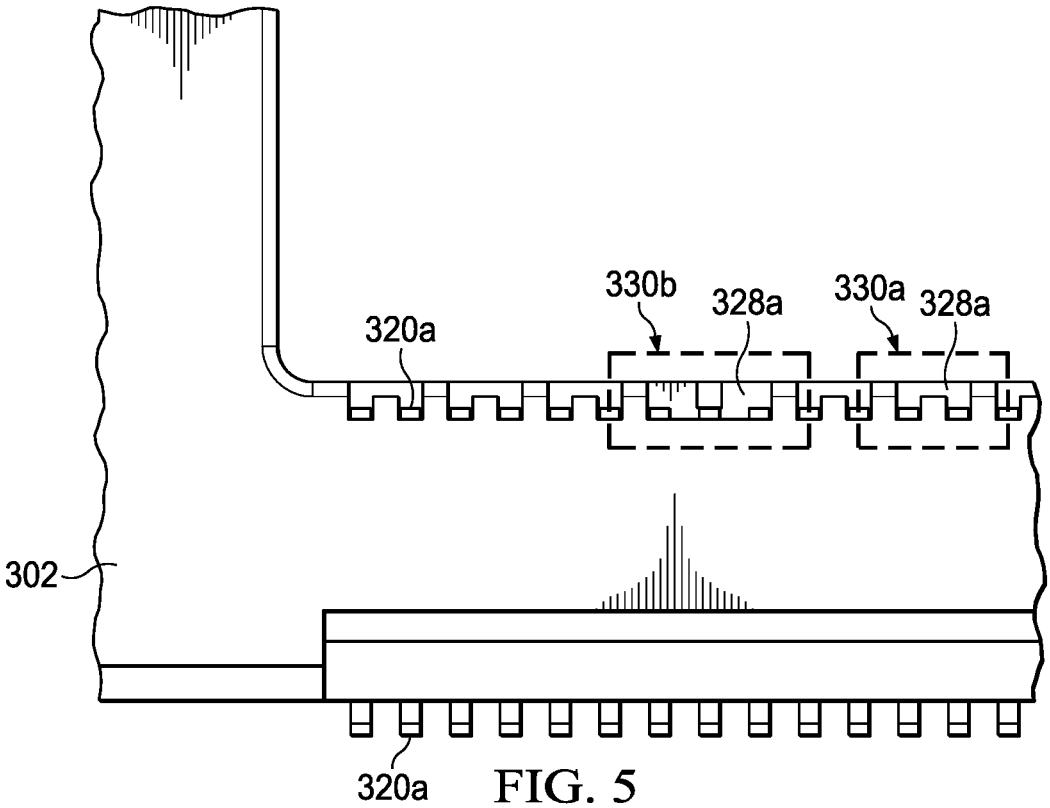
FIG. 5 is a cross-section view of the memory module socket.

Referring to FIGS. 3C, 4, and 5, the first member 302 can include a plurality of first resistive coatings 328*a*. Each of the first resistive coatings 328*a* can connect two or more of the first contact pins 320*a* to define first groupings of the first contact pins 320*a*. In some examples, a particular first resistive coating 328*a* can connect two of the first contact pins 320*a*, defining a first grouping 330*a* of the first contact pins 320*a*. The first contact pins 320*a* of the first grouping 330*a* can include a ground pin and a data pin. In some examples, a particular first resistive coating 328*a* can connect three of the first contact pins 320*a*, defining a first grouping 330*b* of the first contact pins 320*a*. The first contact pins 320*a* of the first grouping 330*b* can include a ground pin, and two data pins.

Similarly, the second member 304 can include a plurality of second resistive coatings 328*b*. Each of the second resistive coatings can connect two or more of the second contact pins 320*b* to define first groupings of second contact pins 320*a*. In some examples, a particular second resistive coating 328*b* can connect two of the second contact pins 320*b*, defining a first grouping (not shown) of the second contact pins 320*b*. The second contact pins 320*b* of the first grouping (not shown) can include a ground pin and a data pin. In some examples, a particular second resistive coating 328*b* can connect three of the second contact pins 320*b*, defining a first grouping (not shown) of the second contact pins 320*b*. The second contact pins 320*b* of the first grouping (not shown) can include a ground pin, and two data pins.

Referring to FIGS. 3B and 3C, the first member 302 can include a plurality of first ribs 350*a*. The first ribs 330*a* can separate the first groupings 330*a* of the first contact pins 320*a*. The first ribs 350*a* can extend between the top side 250 and the bottom side 252 of the memory module socket 212, at least partially, or wholly. The first member 302 can include additional first ribs 352*a*. In some examples, the additional first ribs 352*a* can be positioned within first groupings 330*a* of the first contact pins 320*a*, and separate the first contact pins 320*a* within the first groupings 330*a*. In some examples, the first groupings 330*a* of the first contact pins 320*a* do not include the additional first ribs 352*a*. The additional first ribs 352*a* can extend between the top side 250 and the bottom side 252 of the memory module socket 212, at least partially, or wholly.

Similarly, the second member 304 can include a plurality of second ribs 350*b*. The second ribs 330*b* can separate the first groupings (not shown) of the second contact pins 320*b*. The second ribs 350*b* can extend between the top side 250 and the bottom side 252 of the memory module socket 212, at least partially, or wholly. The second member 304 can include additional second ribs 352*b*. In some examples, the additional second ribs 352*b* can be positioned within first groupings (not shown) of the second contact pins 320*b*, and separate the second contact pins 320*b* within the second groupings 330*b*. In some examples, the first groupings (not shown) of the second contact pins 320*b* do not include the additional second ribs 352*b*. The additional second ribs 352*b* can extend between the top side 250 and the bottom side 252 of the memory module socket 212, at least partially, or wholly.

The ribs 350*a*, 350*b*, 352*a*, 352*b* can minimize, reduce, and/or prevent, inadvertent contact between any of the first contact pins 320*a* and/or any of the second contact pins 320*b*. The ribs 350*a*, 350*b*, 352*a*, 352*b* can additionally help guide translation/movement of the first contact pins 320*a* and the second contact pins 320*b* from a first position to a second position, e.g., when the memory module 210 is coupled/engaged and decoupled/disengaged from the memory module socket 212, described further herein.

Referring back to FIGS. 4 and 5, the first contact pins 320*a* and the second contact pins 320*b* are in a first position. In some examples, when the first contact pins 320*a* and the second contact pins 320*b* are in the first position, the memory module 210 is decoupled/disengaged from the memory module socket 212. That is, the decoupling/disengagement of the memory module 210 from the memory module socket 212 places the first contact pins 320*a* and the second contact pins 320*b* in the first position.

When the first contact pins 320*a* are in the first position, the second contact points 324*a* are in contact with respective first resistive coatings 328*a* to complete a termination to ground. For example, the first contact pins 320*a* can include a natural spring force such that the second contact points 324*a* of the first contact pins 320*a* are in contact with respective first resistive coatings 328*a* when the memory module 210 is decoupled/disengaged from the memory module socket 212. In other words, when the memory module 210 is decoupled/disengaged from the memory module socket 212, the spring force of the first contact pins 320*a* can press the second contact points 324*a* against the respective first resistive coatings 328*a* and complete a signal-resistor-ground circuit.

Additionally, when the second contact pins 320*b* are in the first position, the second contact points 324*b* are in contact with respective second resistive coatings 328*b* to complete a termination to ground. For example, the second contact pins 320*b* can include a natural spring force such that the second contact points 324*b* of the second contact pins 320*b* are in contact with respective second resistive coatings 328*b* when the memory module 210 is decoupled/disengaged from the memory module socket 212. In other words, when the memory module 210 is decoupled/disengaged from the memory module socket 212, the spring force of the second contact pins 320*b* can press the second contact points 324*b* against the respective second resistive coatings 328*b* and complete a signal-resistor-ground circuit.

Figure 6:
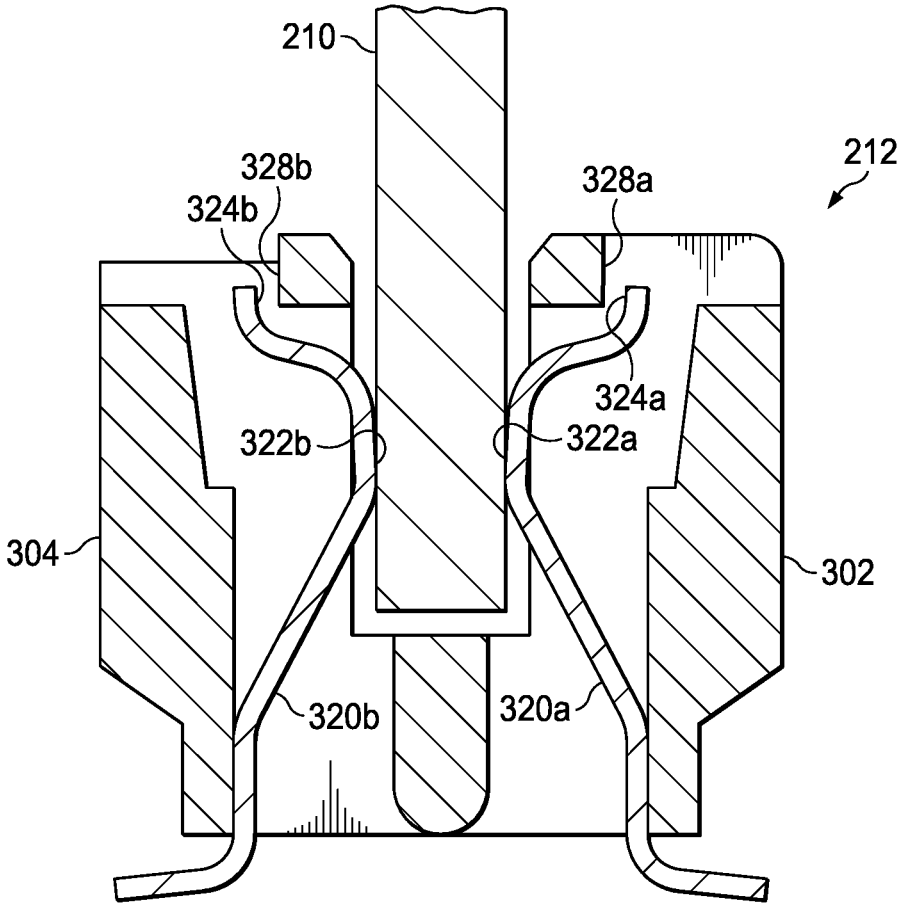
FIG. 6 is a side cutaway view of the memory module socket, with the memory module coupled with the memory module socket

FIG. 6 illustrates the first contact pins 320*a* and the second contact pints 320*b* in a second position. In some examples, when the first contact pins 320*a* and the second contact pins 320*b* are in the second position, the memory module 210 is coupled/engaged with the memory module socket 212. That is, the coupling/engagement of the memory module 210 with the memory module socket 212 places the first contact pins 320*b* and the second contact pins 320*b* in the second position.

When the first contact pins 320*a* are in the second position, the first contact points 322*a* are in contact with the memory module 210. For example, the first contact pins 320*a* can include a natural spring force such that the first contact points 322*a* of the first contact pins 320*a* are in contact with the memory nodule 210 when the memory module 210 is coupled/engaged with the memory module socket 212. Furthermore, when the first contact pins 320*a* are in the second position, the second contact points 324*a* of the first contact pins 230*a* are not in contact with the respective first resistive coatings 328*a* and are disconnected from termination. In other words, when the memory module 210 is coupled/engaged with the memory module socket 212, the memory module 210 can prevent the second contact points 324*a* of the first contact pins 320*a* from contacting the respective first resistive coatings 328*a* and disconnected from ground termination.

Additionally, when the second contact pins 320*b* are in the second position, the second contact points 322*b* are in contact with the memory module 210. For example, the second contact pins 320*b* can include a natural spring force such that the second contact points 322*b* of the second contact pins 320*b* are in contact with the memory module 210 when the memory module 210 is coupled/engaged with the memory module socket 212. Furthermore, when the second contact pins 320*b* are in the second position, the second contact points 324*b* of the second contact pins 230*b* are not in contact with the respective second resistive coatings 328*b* and are disconnected from termination. In other words, when the memory module 210 is coupled/engaged with the memory module socket 212, the memory module 210 can prevent the second contact points 324*b* of the second contact pins 320*b* from contacting the respective second resistive coatings 328*b* and disconnected from ground termination.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated other-wise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, features, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

What is claimed is:

1. A memory module socket, comprising:

a first member extending between a first end and a second end of the socket, the second end of the socket opposite to the first end of the socket, the first member positioned along a first side of the socket, the first member including:

a plurality of first contact pins, each of the first contact pins including a first contact point and a second contact point, each of the first contact pins extending between a top side and a bottom side of the memory module socket, the top side opposite to the bottom side, the second contact point of each of the first contact pins positioned proximate to the top side of the memory module socket and the first contact point of each of the first contact pins positioned between the top side and the bottom side of the memory module socket;

a plurality of first resistive coatings connecting two or more of the first contact pins to define first groupings of contact pins, the first resistive coatings positioned at an exposed surface of the memory module socket at the top side of the memory module socket;

a plurality of first ribs separating each of the first groupings of first contact pins;

wherein when the first contact pins are in a first position, the second contact points, at the top side of the memory module, of the first contact pins are in contact with respective first resistive coatings, at the top side of the memory module, to complete a termination to ground.

2. The memory module socket of claim 1, further comprising:

a second member extending between the first end and the second end of the socket, the second member positioned along a second side of the socket, the second side of the socket opposite to the first side of the socket, the second member including:

a plurality of second contact pins, each of the second contact pins including a first contact point and a second contact point;

a plurality of second resistive coatings connecting two or more of the second contact pins to define second groupings of contact pins; and a plurality of second ribs separating each of the second groupings of second contact pins.

3. The memory module socket of claim 2, wherein when the second contact pins are in the first position, the second contact points of the second contact pins are in contact with respective second resistive coatings to complete a termination to ground.

4. The memory module socket of claim 3, wherein when the first and the second contact pins are in the first position, a memory module is decoupled from the socket.

5. The memory module socket of claim 4, wherein when the first and the second contact pins are in a second position, the first contact points of the first and the second contact pins contact the memory module, and the second contact points of the first and the second contact pins are disconnected from termination.

6. The memory module socket of claim 5, wherein when the first and the second contact pins are in the second position, the memory module is coupled to the socket.

7. The memory module socket of claim 1, wherein a first contact pin of the first grouping of contact pins is a ground pin.

8. The memory module socket of claim 7, wherein a second contact pin of the first grouping of contact pins is a data pin.

9. The memory module socket of claim 8, wherein a third contact pin of the first grouping of contact is a data pin.

10. An information handling system, comprising:

a processor;

memory media storing instructions executable by the processor to perform operations;

a memory module socket, including:

a first member extending between a first end and a second end of the socket, the second end of the socket opposite to the first end of the socket, the first member positioned along a first side of the socket, the first member including:

a plurality of first contact pins, each of the first contact pins including a first contact point and a second contact point, each of the first contact pins extending between a top side and a bottom side of the memory module socket, the top side opposite to the bottom side, the second contact point of each of the first contact pins positioned proximate to the top side of the memory module socket and the first contact point of each of the first contact pins positioned between the top side and the bottom side of the memory module socket;

a plurality of first resistive coatings connecting two or more of the first contact pins to define first groupings of contact pins, the first resistive coatings positioned at an exposed surface of the memory module socket at the top side of the memory module socket;

a plurality of first ribs separating each of the first groupings of first contact pins;

wherein when the first contact pins are in a first position, the second contact points at the top side of the memory module, of the first contact pins are in contact with respective first resistive coatings, at the top side of the memory module, to complete a termination to ground.

11. The information handling system of claim 10, wherein the memory module socket further comprising:

a second member extending between the first end and the second end of the socket, the second member positioned along a second side of the socket, the second side of the socket opposite to the first side of the socket, the second member including:

a plurality of second contact pins, each of the second contact pins including a first contact point and a second contact point;

a plurality of second resistive coatings connecting two or more of the second contact pins to define second groupings of contact pins; and a plurality of second ribs separating each of the second groupings of second contact pins.

12. The information handling system of claim 11, wherein when the second contact pins are in the first position, the second contact points of the second contact pins are in contact with respective second resistive coatings to complete a termination to ground.

13. The information handling system of claim 12, wherein when the first and the second contact pins are in the first position, a memory module is decoupled from the socket.

14. The information handling system of claim 13, wherein when the first and the second contact pins are in a second position, the first contact points of the first and the second contact pins contact the memory module, and the second contact points of the first and the second contact pins are disconnected from termination.

15. The information handling system of claim 14, wherein when the first and the second contact pins are in the second position, the memory module is coupled to the socket.

16. The information handling system of claim 10, wherein a first contact pin of the first grouping of contact pins is a ground pin.

17. The information handling system of claim 16, wherein a second contact pin of the first grouping of contact pins is a data pin.

18. The information handling system of claim 17, wherein a third contact pin of the first grouping of contact is a data pin.

* * * * *